United States Patent [19]

Pettersson

[11] 4,452,662

[45] Jun. 5, 1984

[54] DEVICE FOR THE FASTENING OF BUTTONS TO A PIECE OF GARMENT OR OTHER TEXTILE PRODUCT

[75] Inventor: Bengt O. Pettersson, Kungsbacka, Sweden

[73] Assignee: NPI New Products Investment AB, Askim, Sweden

[21] Appl. No.: 309,884

[22] PCT Filed: Jan. 30, 1981

[86] PCT No.: PCT/SE81/00028

§ 371 Date: Oct. 5, 1981

§ 102(e) Date: Oct. 5, 1981

[87] PCT Pub. No.: WO81/02245

PCT Pub. Date: Aug. 20, 1981

[30] Foreign Application Priority Data

Feb. 7, 1980 [SE] Sweden ..... 8000983

[51] Int. Cl.[3] ..... A41H 37/10; A44B 1/42

[52] U.S. Cl. ..... 156/562; 2/265; 24/90 HA; 24/96; 156/92; 156/569; 156/580.1; 156/583.1

[58] Field of Search ..... 156/73.1, 92, 556, 558, 156/560, 562, 569, 580.1, 580.2, 583.1; 24/90 HA, 96, 101 R; 2/265

[56] References Cited

U.S. PATENT DOCUMENTS

| | | | |
|---|---|---|---|
| 3,019,152 | 1/1962 | Jones | 156/562 |
| 3,238,082 | 3/1966 | Cornell | 156/583.1 |
| 3,416,196 | 12/1968 | Mathison | 24/90 HA |
| 3,696,470 | 10/1972 | Reynolds et al. | 24/90 HA |
| 4,312,077 | 1/1982 | Petersson | 2/265 |

FOREIGN PATENT DOCUMENTS

WO79/00777 10/1979 PCT Int'l Appl. .

*Primary Examiner*—Michael G. Wityshyn

[57] ABSTRACT

Device for the fastening of buttons (12) to a piece of garment (56), exhibiting a first portion provided with a number of button holes, and a second portion, to which the buttons shall be fastened without sewing with their projections. A holding means (5) is arranged to hold the buttons (12) in a position in between them corresponding to the position in between the buttonholes and means for holding the first portion of the garment. A feeding device (3, 4) for the buttons (12) extends to the mentioned holding means (5). A second holding means (6) with means (50) is arranged to hold the second portion of the piece of garment, and a processing means (52) for the fastening of the projections. The second holding means (6) is fixed and has its device for holding the second portion of the piece of garment substantially pointing in upwards direction. The first holding means can be displaced between a first position at a distance from the second holding means (6) and a second position, in which the projections contact the second portion held by the second holding means and are brought in contact with the processing means (52), and its mentioned devices in the first position will be directed upwards/forwards towards the second holding means. By means of this the devices of the two holding means will be easily accessible for application of the piece of garment and the projections will be situated in such a way that the entering of the button-holes will be facilitated. The feeding device (3, 4) has a fixed position close to the first position of the first holding means and transfers the buttons when the first holding means is situated in this position but is arranged not to prevent the movement of the holding device to its second position.

5 Claims, 5 Drawing Figures

DEVICE FOR THE FASTENING OF BUTTONS TO A PIECE OF GARMENT OR OTHER TEXTILE PRODUCT

TECHNICAL FIELD

The present invention relates to a device for the fastening of buttons to for example a piece of garment. The fastening operation is intended to take place without any sewing operation and in a working cycle automated to a high degree. The intention is that a number of buttons should be fastened preferably at the same time in the same working cycle.

BACKGROUND

It is earlier known to fasten buttons to textile materials or similar without recurring to any sewing operation by fastening a projecting portion of the button to the material by means of riveting or a corresponding operation. The projection can in itself be designed to be formed to a rivet head, which cannot penetrate the material and holds the button, but there are also buttons designed with the head as a separate part, which is snapped-on or riveted to the head portion of the button. It has also been suggested in connection with such buttons that several buttons should be fastened simultaneously by way of example a whole row of buttons on a piece of garment, and it has been suggested that the projections should be inserted in the button holes corresponding to the respective cooperating buttons before the fastening. Thus, after the fastening operation the piece of garment would be buttoned up. In many cases it is preferred to deliver the garment for sale in buttoned-up condition, and if the buttons are fastened in a condition with their projections stretching through the buttonholes, a special buttoning-up operation is thus not necessary.

TECHNICAL PROBLEM

However, it has turned out that the manual preparations for such a fastening operation will require precision and is time consuming to perform, as several projections in succession shall be inserted through the buttonholes, whereafter the portion of the piece of garment, where the buttonholes are located, shall be in this position while that part of the piece of garment on which ends of the projections should be fastened and establishes the fastening operation. It is obvious that in order to carry out an operation within a reasonable time and with an acceptable result, good mechanical means are required.

THE SOLUTION

The object to obtain rational mechanical means for the mentioned operation is provided by means of a device, in which holding means for fastening of the different parts of the piece of garment or similar has a free and accessible position during the manual part of the fastening operation which is probable.

ADVANTAGES

By means of said solution it is obtained that different parts of for example a piece of garment on which the button-holes are situated and the buttons should be situated can be applicated in the machine in a convenient way, so that the application time can be reduced to the least possible one. It is also important that a great observation conditions are obtained, to make it possible to easily control if the mentioned parts have reached their correct positions.

BEST MODE OF CARRYING OUT THE INVENTION

Figure 3:
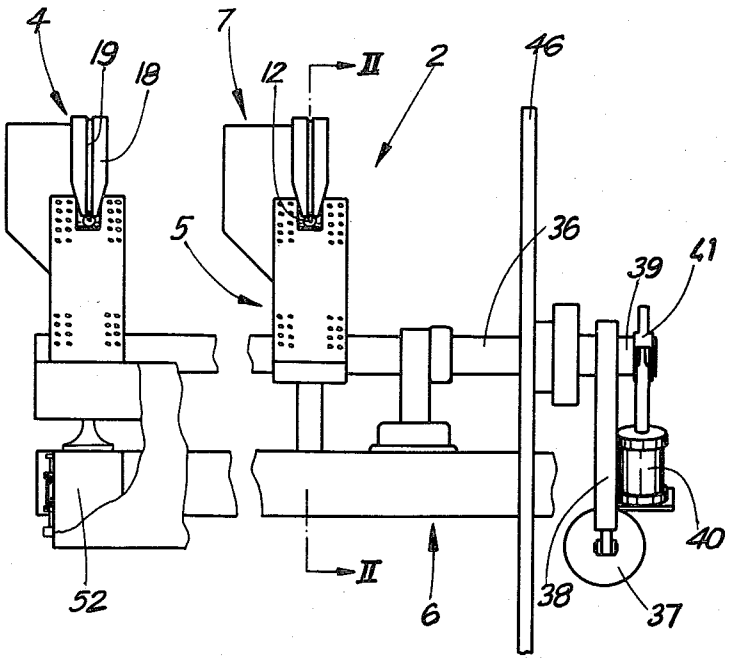
FIG. 3 is a front view of the device.

According to the figures the device exhibits a frame 1, which supports a row of button fastening means 2. In FIG. 3, which is a front view, two button fastening means 2 are shown. However, from considerations of space the frame is broken, and it is the intention that it shall carry as many button fastening means as the number of buttons intended to be fastened in the same fastening operation. Thus, if a shirt shall be provided with buttons six to eight button fastening means are required. They are, however, of identical design, and the following description consequently relates to all the fastening means 2.

Figure 5:
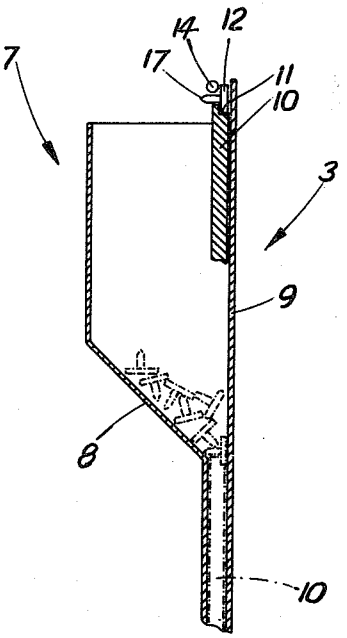
FIG. 5 is a cross-sectional view of a detail of the device along the line V—V in FIG. 1.

A button fastening means 2 comprises a number of main parts, viz. a hopper 3, a feeding path 4, a pivoting arm 5, and processing means 6. The hopper is shown in a sectional view in FIG. 5 and comprises a receptacle 7 with an inclined bottom 8 and a vertical wall 9. A slide 10 with a recess 11 at its upper edge is movable along the wall 9 and forms together with the surface of said wall 9 a groove, which is adjusted to the head of the button 12, which is intended to be used in the fastening operation. The slide 10 can by means of a power cylinder 13 (FIG. 1) be displaced in upwards and downwards direction along the wall 9 and has an upper turning point, which is shown with continuous lines in FIG. 5. In this position the recess 11 cooperates with a bar 14 extending in crosswise direction relative to the hopper, so that a space is obtained, in which the head of the button 12 is held, and from which the button cannot escape, but which space at the same time forms a groove, in which the button can be displaced in sidewise direction (at right angle to the plane of the paper in FIG. 5). At its lower turning point, which is shown with dashed and dotted lines in FIG. 5, the recess of the slide is located at the lower end of the inclined button 8. Right in front of the recess 11 and the bar 14 forming said groove is located an air nozzle 15 and at the opposite side a continuation to the groove in the form of a ledge 16, which is turned in such a manner that the path for the buttons turns off from the position shown in FIG. 5, in which the projections 17 of the buttons 12 point sidewise, into a position, in which they point in an upwards direction. The ledge 16 continues in a curved path 18 with a groove 19 for the button, the end portion of the path 18 exhibiting an oblique inclination in backwards-upwards direction as seen from the front side of the machine, which is to the right in FIG. 1. The path 18 with the groove 19 is shown in a cross-sectional view in FIG. 2, and it is evident from this figure that there is a feeder 20 in said groove, which feeder is pivoted in a shaft 21. The feeder 20 exhibits partly a lower projection 22, which is fixed, and partly an upper projection 23 in the form of a pin, that can springingly yield inwards, and which is subjected to the bias of a spring 24. There is moreover a downwards pointing projection 25. The two projections 22 and 23 can alternatively be inserted into the groove 19 by a pivoting movement of the feeder 20. The feeder then tends to occupy a position in which the projection 22 is pivoted into the groove and the projection 23 is pivoted out of the same by the feeder, being actuated by a spring 26 via a pin 27, that can be displaced in a hole. The feeding mechanism can be brought to occupy the position shown in FIG. 2 by being forced thereto by striking against the projection 25.

Figure 4:
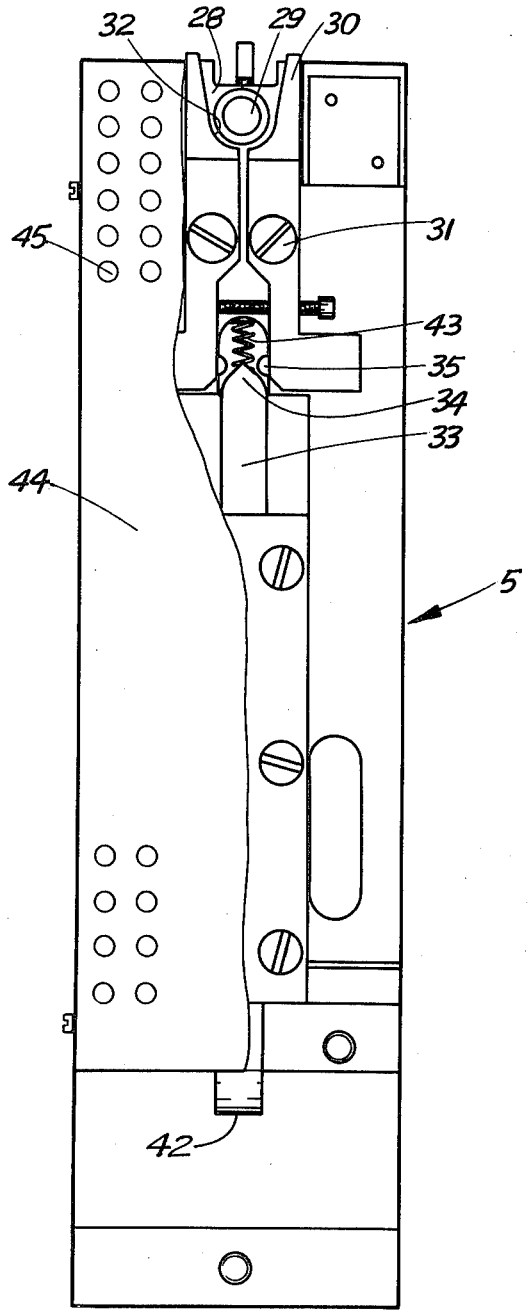
FIG. 4 is a partly sectional view of a detail as seen in the same direction as in FIG. 3, but on an enlarged scale.

The pivoting arm 5 is placed at the open end of the groove 19, which represents the end of the feeding path 4, said pivoting arm 5 exhibiting a retaining position 28 for the button 12, which is a continuation of the groove 19. In the retaining position 28 there is a support 29 behind the button 12 exhibiting a pressure surface facing the principal surface of the button and carefully adjusted to the same. The retaining position 28 is formed by two jaws 30, which are pivoted each one on its shaft 31. In the position illustrated in FIG. 4, in which the extreme ends are pivoted outwards away from each other, a button in the retaining position 28 can without obstruction be moved outwards-forward (in FIG. 2 to the right), while said button when the jaws are pivoted inwards towards each other, is held of the jaws, the surfaces 32 of which are adapted to the contour of the button. The jaws tend to occupy the outwards pivoted position illustrated in FIG. 4 being actuated by a spring, not shown. They can move into their inwards pivoted position by means of a bar 33, which is displaceable in the longitudinal direction of the pivoting arm, and with a pointed end 34 which can penetrate between the cam surfaces 35 of the jaws. When said spring is in its downwards pulled position illustrated in FIG. 4 it can pivot the low ends of the jaws in inwards direction and consequently the upper ends in outwards direction, so that the retaining position 28 is freely accessible. On the other hand, if the bar 33 is pressed in upwards direction, it will penetrate between the cam surfaces 35 and pivot the jaws with their low ends in outwards direction, so that the upper ends pivot inwards and hold a button placed in said retaining position. The pivoting arm at its outer end exhibits a pin 55, which can strike against the projection 25.

Figure 1:
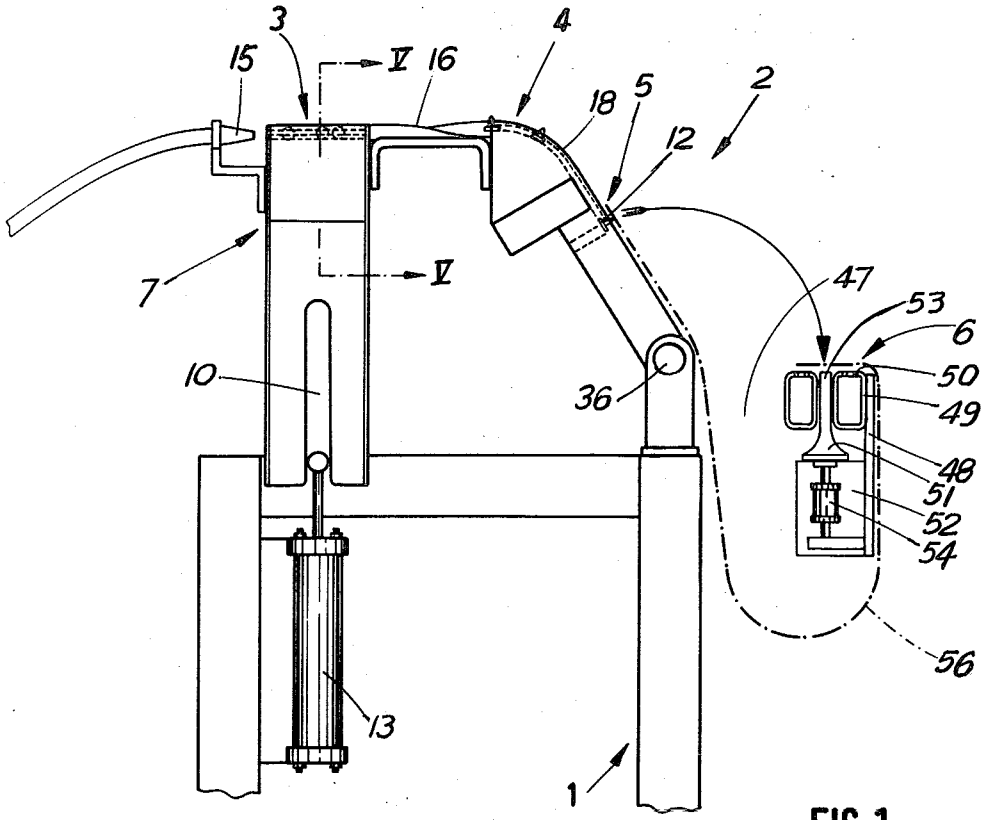
FIG. 1 is a side elevational view of the device.

The pivoting arm 5 is pivotable from the position shown in FIG. 1 right in front of the mouth of the groove 19 into a substantially horizontal position with an inserted button in contact with the processing means 6. The pivoting movement, which shall take place simultaneously for all the pivoting arms 5, is performed by means of a tubular shaft 36 supported in the stand 1, which tubular shaft 36 can be moved into different pivoting positions by means of a power cylinder 37, which actuates a lever arm 38. There is a camshaft 39 inside the tubular shaft 36, which camshaft can be pivoted relative to the tubular shaft 37 by means of a power cylinder 40, which is connected with the shaft 39 by means of a lever arm 41, and which is supported by the lever arm 38 and thus follows in the pivoting movement of the tubular shaft 36. The camshaft 39 is in connection with the low ends 42 of the bars 33 and can either occupy a position with a recess or with its full outer diameter right in front of the bars 33. In the first mentioned case the bar 33 under bias of a spring 43 can be in the downwards pulled position illustrated in FIG. 4, in which the jaws 30 consequently are not actuated, whereas the bar has been pulled upwards and penetrated between the cam surfaces 34, when the tubular shaft has been pivoted in such a manner that the end 42 rests against its outer diameter. A hood 44 extends over the pivoting arm 5, and a cavity is formed inside said hole which opens towards the front side of the pivoting arm by means of a number of holes 45. The hollow space is by means of devices, not shown, connected with a source of negative pressure.

The processing means 6 forms a bar of long extension, of which one end is fastened to a plate 46 (FIG. 3) forming part of the stand, whereas its opposite end is free. By this arrangement the processing means because it is located in front of the main portion of the stand 1, forms a space 47, which consequently is accessible at one end (to the left in FIG. 3). Holding means is formed by a front plate 48 and tubular beams 49 located at the upper end of the same and at a certain distance from each other, said tubular beams exhibiting upwards directed openings 50. The tubular beams are connected with the source of negative pressure mentioned. The tubular beams 49 are kept separated from each other by means of spacer elements, not shown, and in the opening between them there are processing elements in the form of bars 51, which extend in upwards direction and are connected with a magnetic or piezo-electric vibrator 52. The upper ends 53 of the bars 51 are in such a position that, when the pivoting arm 5 is in its downwards pivoted position, the button 12 placed in the position 28 contacts said upper end with its projection 17. The vibrator means 52 with their bars 51 are by means of power cylinders 54 individually movable between the working position illustrated in FIG. 1 and a bottom position. The vibrator means are connected with an ultra sonics generator producing an alternating current with a frequency of from 18.000 to 30.000 Hz. By feeding this current to the vibrator means, they will consequently produce ultra sonic vibrations of a corresponding frequency in the bars 51.

If its is assumed that a row of buttons, by way of example eight units, shall be fastened to a shirt, the machine consequently being equipped with eight fastening means 2, one shall proceed in the following manner. It is assumed that the shirt is finished with the buttonholes and that the eight buttons shall be fastened in a row along the low portion of the front side.

At the start of the machine buttons are filled in the recipient 7 of the hopper 3. The buttons, which are indicated 12, as has been mentioned previously are pivoted with a head and a pointed projection 17 at one side of the head. This projection shall be joined with the low portion of the front side of the shirt as the projection is run through the respective buttonhole. The opposite side of the head then constitutes the front side of the button. The buttons deposited in the recipient 7 flock together on the bottom 8 and inwards toward the wall 9. By upwards and downwards stokes of the slide 10 actuated by the power cylinder 30 these buttons, which have landed in a position with the head downwards in the recess 11, will follow the slide in upwards direction, whereas buttons, which have not occupied said position, will fall off during the upwards stroke of the cylinder and again land on the bottom 8. During the movements of the slide there will always be a certain number of buttons in the correct position for the transportation up to the upper position shown with continuous lines in FIG. 5, thus, the groove formed by the recess 11 and the bar 14. Each time the slide 10 halts in its upper turning position, a control unit actuates a compressed air system to send a blast of compressed air through the sleeve 15, which causes the button or buttons present in said groove to be transported to the ledge 16 and in the groove of the ledge further on to the path 18 and via the groove 19 on towards the projection 22. It is then assumed that the pivoting arms 5 are pivoted in downwards direction, so that the pin 55 does not actuate the projection 25, and the feeding machanism 20 consequently is pivoted with the projection 22 into the groove 19 under the bias of the spring 26.

Figure 2:
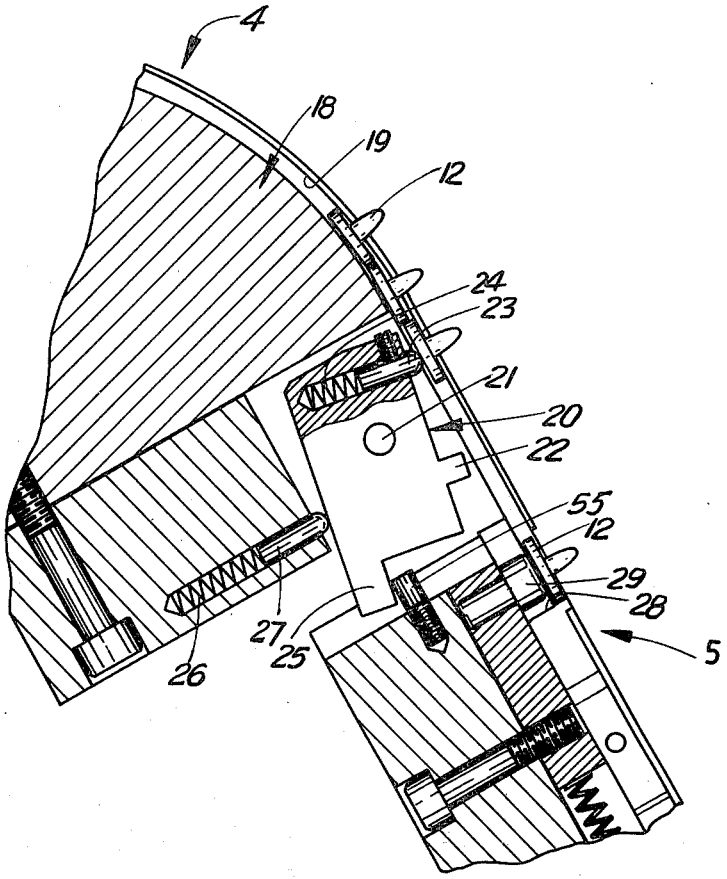
FIG. 2 is a cross-sectional view along the line II—II in FIG. 3 showing a detail in the same direction as in FIG. 1 but on an enlarged scale.

When the pivoting arms 5 are pivoting in upwards direction, which takes place by the pivoting of the tubular shaft 36 by means of the power cylinder 37, the pin 55 will contact the projection 25 of the feeding mechanism 20, so that it will be pivoted into the position shown in FIG. 2. The button previously resting against the projection 22 then looses its support and falls down into the position 28 on the pivoting arm. However, it is impeded that more buttons follow the first one, as the springing pin 23 pinches the nearest above placed button in the groove 19. At the moment the pivoting arm reaches its upwards pivoted position, the camshaft 39 is turned into such a position that the bar 33 is in its low position and the position 28 is consequently open to receive the button in question. However, immediately in connection with the pivoting arm reaches its upwards pivoted position, the camshaft 39 is by means of the power cylinder 40 and the bar 33 pushed upwards, so that the button is pinched in the position 28 by means of the jaws 30 with the front portion of its head resting against the supporting surface of the support 29.

The starting position for the fastening operation has now been reached. There is then a row of buttons with their projections pointing in outwards and upwards direction and held in the respective pivoting arms. The upper front portion of the piece of garment 56 is now taken hold of in both its ends, whereafter it is stretched and with the buttonholes moved towards the points of the projections 17. The source of negative pressure is in the meantime working and produces an inwards directed flow of air through the openings 45. As soon as the upper front portion of the piece of garment has been laid against the pivoting arms, it is therefore held by the underpressure, and if one has not succeeded in getting all the projections into the buttonholes, it is easy to adjust the individual buttonhole portions in such a manner that all the projections penetrate out through the respective buttonholes. The remaining portion of the piece of garment, that has been inserted into the opening 47, now hangs down in this opening, and the outer border of the downwards hanging portion i.e. the low portion of the front border of the piece of garment, is now gripped. This border is moved upwards round the operating equipment 6, as is shown by dashed and dotted lines in FIG. 1, and is laid against the tubular beams 49, also this portion being held because of the underpressure in the openings 50. This portion of the piece of garment is now adjusted into a predetermined position according to directional marks, which can be marked out on the tubular beams.

When the piece of garment has in this manner been put in place, operating means, not shown, are actuated, which results in a downwards pivoting of the pivoting arms 5 by means of the power cylinder 37 via the tubular shaft 36. The projections of the buttons will then contact the border of the piece of garment resting against the tubular beams 48 with a support from below by the pressure surfaces 53. The vibrator means 52 are now started and give rise to ultrasonic vibrations in the bars 51. This results in a flow of the material at the point of the projections 17, so that they from deformation heads, which are partly integrated with the textile material of the piece of garment, so that a secure fastening of the buttons is obtained. This operation takes place in the quickest manner, if all of the vibrator means 52 are driven simultaneously. However, in order to make possible to equip the device with an ultrasonic generator of smaller dimensions, one can let the vibrator means work separately in turn after each other or in groups. This can be performed by the vibrator means or the groups of them being electrically cut-in by turn, and at the same time they can be arranged during the coupling time to be pressed upwards in order to reach contact with the projections by means of their respective power cylinders 54, whereas the vibrator means, which are not working, remain somewhat lowered down. Even though the vibrator means are individually driven after each other, the joining operation is finished within a few seconds and all buttons are thus securely anchored to the article of dress at the same time as the same is buttoned-up. When the operation is finished, the camshaft 39 is turned and the lever arms 30 release the buttons, whereafter the pivoting arms 5 are pivoted upwards. The piece of garment can be extracted from the operating equipment 6 via the free end of the same.

When at the start of the operation the pivoting arms 5 swung downwards the feeding mechanism 20 was no longer actuated, and under bias of the spring 26 the projection 22 therefore pivoted into the groove 19, whereas the projection 23 left the same. The buttons, which previously were held by the projections 23, then fell down with the lowermost button resting against the projection 22. When the pivoting arm 5 again occupies its upper position and again pivots aside the feeding mechanism 20, a new button therefore falls into the position 28 at the same time as the button lying above is pinched by the projection 23. The machine is then ready for a new fastening operation to a new piece of garment.

INDUSTRIAL APPLICABILITY

An important principle in connection with industrial use of the machine according to the invention is the one that its two fastening stations for the respective portions of the piece of garment i.e. the row of pivoting arms 5 with their hoods 44 and the tubular beams 49 respectively in one position are at a distance from each other and both in an at least partly upwards pivoted position. By this arrangement the necessary manual application of the respective portions of the piece of garment can take place with a good view and in a comfortable working position. The good view is very important, as the slightest error in connection with the adjustment of the portions of the piece of garment inevitably lead to the rejection of the same. Thus, if any projection should not have penetrated its respective buttonhole, the projection will be fastened to the upper portion of the piece of garment, which is completely unacceptable, and should the lower portion of the piece of garment not be properly aligned, the buttons will be fastened in the wrong position resulting in an ill-fitting piece of garment in buttoned-up condition. In the fastening operation the two portions of the piece of garment must on the other hand be brought together, and in order to make this possible, it is important that the portions of the piece of garment are carefully held during the movement, which represents another important fundamental principle for the machine. An important solution in connection with the machine is represented by the means for the feed of the buttons to the outer end of the movable holding device for the buttons, i.e. the pivoting arms 6.

It has been assumed in the description that the fastening of the buttons shall take place by material deformation by means of vibrations in the ultrasonic range of frequency. However, it can be imagined to utilize the machine for other methods of fastening, if the vibrator means are exchanged for other operating means such as heating of riveting means.

I claim:

1. A device for fastening buttons, each having a projection, to a textile product having a first portion with a number of button holes for cooperation with the buttons, and a second portion to which the buttons shall be fastened with their projections, said device comprising:

first holding means having means for holding the buttons in spaced positions corresponding to the spaces between buttonholes in such a position that the projections freely extend in a common direction and also having means for holding the first portion of the product;

feeding means for the buttons including a hopper, feeding members and a feeding path which extends to said first holding means;

second holding means with members for holding the second portion of the product;

processing means for fastening the projections to the second portion of the product;

and moving means for bringing together said first and second holding means in a position in which the projections contact the second portion held by said second holding means and are held in contact with said processing means when the first portion with its buttonholes over the projections is in an opposite position close to said second portion, so that, when said processing means is activated the projections are fastened to the second portion with the buttons thereafter in buttoned-up condition relative to the first portion;

said second holding means being fixed and its members for holding the second portion of the product substantially pointing in upwards direction;

said first holding means being displaceable by said moving means between a first position at a distance from said second holding means and a second position, in which the projections contact the second portion held by said second holding means and are brought in contact with said processing means;

said moving means being arranged to pivot said first holding means in such a manner that its portion designed to hold the buttons and said first holding means point upwards and forwards towards said second holding means in the first position, whereas said first holding means is substantially pointing downwards towards said second holding means in the second position, whereby said portions of the two holding means are easily accessible in order to put the product in place and the projections will be positioned in such a manner that the threading of the buttonholes over the same is facilitated, said feeding means occupying a fixed position close to the first position of said first holding means and being arranged to transport the buttons to said first holding means, when the same is in the first position, but arranged to permit movement of said first holding means into its second position.

2. A device according to claim 1, wherein said first holding means comprises jaws which are designed to pinch a button in a main portion of the same so that its projection is left free, and first power means for holding said jaws open in order to receive the respective button when it is transported from said feeding means, and for keeping said jaws closed against the button during the displacement of said first holding means and during processing by said processing means and to be kept open after the termination of the processing.

3. A device according to claim 1 or 2, said moving means comprising a first pivoting device supporting said first holding means, a shaft placed at a distance from said first holding means are arranged to pivot lever means and thereby said first holding means, an arm substantially parallel to said shaft and having a free end and forming said second holding means and supporting said processing means and placed in such a manner relative to said shaft that said first holding means by pivoting from its first position at a distance from said second holding means can be brought into its second position close to said second holding means and said processing means, and second power means designed for pivoting said first pivoting device.

4. A device according to claim 3, wherein said processing means comprising bodies which can be pressed against the projections of the buttons, and third power means connected to said processing means for subjecting said bodies to oscillations in an ultrasonic range of frequencies so that such a deformation of the projections can be obtained that they are fastened to the product.

5. A device according to claim 1, said holding means for second portions of the product comprise openings connected with a source of negative pressure, for holding the product by suction effect in the openings.

* * * * *